US011054791B2

(12) United States Patent
Conus et al.

(10) Patent No.: US 11,054,791 B2
(45) Date of Patent: Jul. 6, 2021

(54) TIMEPIECE RATE ADJUSTMENT METHOD

(71) Applicant: ETA SA Manufacture Horlogere Suisse, Grenchen (CH)

(72) Inventors: Thierry Conus, Lengnau (CH); Pascal Winkler, St-Blaise (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 366 days.

(21) Appl. No.: 16/316,388

(22) PCT Filed: Jun. 13, 2017

(86) PCT No.: PCT/EP2017/064426
§ 371 (c)(1),
(2) Date: Jan. 9, 2019

(87) PCT Pub. No.: WO2018/015071
PCT Pub. Date: Jan. 25, 2018

(65) Prior Publication Data

US 2019/0302700 A1 Oct. 3, 2019

(30) Foreign Application Priority Data

Jul. 18, 2016 (EP) ..... 16179847

(51) Int. Cl.
*G04D 7/08* (2006.01)
*G04D 7/12* (2006.01)

(52) U.S. Cl.
CPC ..... *G04D 7/1285* (2013.01); *G04D 7/085* (2013.01); *G04D 7/088* (2013.01); *G04D 7/1264* (2013.01); *G04D 7/1292* (2013.01)

(58) Field of Classification Search
CPC .... G04D 7/1285; G04D 7/1264; G04D 7/085; G04D 7/088; G04D 7/1292
See application file for complete search history.

(56) References Cited

U.S. PATENT DOCUMENTS

| | | | | |
|---|---|---|---|---|
| 2,454,983 | A | 11/1948 | Weinberger | |
| 6,609,822 | B1 | 8/2003 | Tokoro et al. | |
| 9,235,192 | B2 * | 1/2016 | Verardo | G04B 17/06 |
| 9,436,162 | B2 * | 9/2016 | Klinger | G04D 3/0089 |
| 9,804,568 | B2 * | 10/2017 | Paratte | G04B 18/006 |

FOREIGN PATENT DOCUMENTS

| | | | |
|---|---|---|---|
| CH | 691 992 | A5 | 12/2001 |
| CH | 704 693 | A2 | 9/2012 |
| EP | 1 172 714 | A1 | 1/2002 |

OTHER PUBLICATIONS

International Search Report dated Sep. 28, 2017 in PCT/EP2017/064426 filed on Jun. 13, 2017.

* cited by examiner

*Primary Examiner* — Ryan J. Walters
(74) *Attorney, Agent, or Firm* — Oblon, McClelland, Maier & Neustadt, L.L.P.

(57) ABSTRACT

A method for adjusting a rate of a timepiece after encasing a movement to ensure a better rate for the timepiece.

8 Claims, 1 Drawing Sheet

TIMEPIECE RATE ADJUSTMENT METHOD

FIELD OF THE INVENTION

The invention relates to a timepiece rate adjustment method and, more specifically, adjustment of a timepiece movement provided with a balance/balance spring type resonator in order to ensure a better rate for the timepiece.

BACKGROUND OF THE INVENTION

It is known to adjust the rate of a timepiece movement, before it is placed in a case, in different positions, in order to optimize as much as possible the anisochronism curves of the future timepiece. Such a rate adjustment method is, for example, disclosed in EP Patent No. 1172714.

However, it has been found that the rate of a movement correctly set outside its case tends to drift during wear.

SUMMARY OF THE INVENTION

It is an object of the present invention to overcome all or part of the aforementioned drawbacks, by proposing a new method for adjusting the rate of a timepiece.

To this end, the invention relates to a timepiece rate adjustment method including the following steps:

- mounting a movement provided with a balance/balance spring resonator inside a timepiece case;
- measuring the rate of the timepiece;
- determining the correction value to be applied to the balance inertia to obtain a desired rate;
- altering the balance inertia according to said correction value by adding material to the balance.

It is thus understood that the adjustment is not performed simply on the bare movement, i.e. when it has not yet been placed in the case, but that an additional adjustment is advantageously performed according to the invention at the end of the timepiece manufacturing process for fine adjustment of the timepiece, which takes account of variations of rate that occur when the movement is placed in the case, such as, for example, stresses produced on the movement by the encasing operation and/or aerodynamic changes caused by the closed environment of the case.

In accordance with other advantageous variants of the invention:

- the rate measurement is performed with no contact with the balance/balance spring resonator;
- the rate measurement is performed optically or acoustically;
- the correction value is determined by comparing the measured rate and the desired frequency for the resonator;
- the correction value corresponds to the symmetrical arrangement of at least two masses of material on the balance in order to alter the balance inertia without altering its centre of mass;
- the correction value is determined by comparing the measured rate, on the one hand, to the unbalance and frequency desired for the resonator on the other;
- the correction value corresponds to the asymmetrical arrangement of at least one mass of material on the balance in order to alter the balance inertia and its centre of mass;
- the material addition is achieved by a phase of jetting material onto the balance;
- the material includes an adhesive, a paint or a metal suspension;
- the material jetting phase is followed by a solidification phase of the jetted material.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
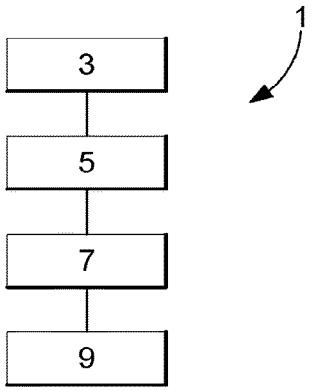
FIG. 1 is a flow diagram of the adjustment method according to the invention.

The invention relates to a timepiece rate adjustment method. The invention more particularly concerns the adjustment of a timepiece movement provided with a balance/balance spring type resonator.

This type of balance/balance spring resonator generally includes a balance providing inertia and a balance spring providing elasticity, which are mounted on the same axis. In this resonator, in a known manner, the moment of inertia I of the balance answers the formula:

$$I=mr^2 \tag{1}$$

where m represents its mass and r its turn radius which also depends on temperature through the expansion coefficient $\alpha_b$ of the balance.

Further, in a known manner, the elastic couple C of the balance spring of constant cross-section answers the formula:

$$C=\frac{Ehe^3}{12L} \tag{2}$$

where E is the Young's modulus of the material used, h the height, e the thickness and L the developed length thereof.

Finally, the frequency f of the balance/balance spring resonator answers the formula:

$$f=\frac{1}{2\pi}\sqrt{\frac{C}{I}} \tag{3}$$

From these three general formulae and from the structure of the movement, it is known to adjust the rate of a timepiece movement, before it is placed in a case, in different positions, in order to optimize as much as possible the anisochronism curves of the future timepiece. This adjustment may consist, in particular, in adapting the unbalance of the balance, the eccentric development of the balance spring or the loss created by the escapement.

However, it has been found that the rate of a correctly adjusted movement tends to drift during wear. After analysis, it was found that the rate changes considerably when the movement is placed in the case due to stresses produced on the movement by the encasing operation and aerodynamic changes caused by the closed environment of the case.

It thus appeared essential for the method 1 according to the invention to include a first step 3 of mounting the movement to be adjusted inside its future timepiece case. In other words, the method starts by placing the movement provided with a balance/balance spring resonator in the case.

A second step 5 is intended to measure the rate of the timepiece, i.e. the encased movement. Preferably, the rate measurement is performed with no contact with the balance/balance spring resonator. Indeed, since the movement is already in its case, access to the resonator is particularly restricted. In a known manner, the timepiece rate measurement can thus be performed, for example, optically or acoustically.

This second step 5 is important for two reasons. Thus, on the one hand, it allows the measured rate to be compared to a desired rate. On the other hand, it also makes it possible to know the beat of the balance in order to synchronise it with the material jetting process and deposit material precisely on the balance.

Method 1 continues with a third step 7 intended to determine the correction value to be applied to the balance inertia to obtain a desired rate.

According to a first embodiment, in step 7, the correction value is determined by comparing the measured rate to the desired frequency for the resonator especially by means of equations (1) to (3) above.

As explained above, since the last step 9 is intended to add material to the balance, the adjustment according to the invention only allows the moment of inertia I of the balance to be increased. It is clear, therefore, that the encased movement is preferably arranged to have a gain which will be corrected in the last step 9.

According to the first embodiment, the correction value thus corresponds to a symmetrical arrangement of at least two masses of material on the balance in order to alter the balance inertia without altering its centre of mass. It is clear that the correction value will be evenly distributed according to the desired number of depositions. By way of non-limiting example, if the material is deposited on the balance rim, the correction value will be divided by the desired number of depositions and each deposition will be distributed over the rim at an angle $\delta$ equal to 360° divided by the desired number of depositions.

According to a second embodiment, in step 7, the correction value is determined by comparing the measured rate on the one hand, to the desired resonator unbalance and frequency on the other, especially by means of equations (1) to (3) above. It is thus clear that the second embodiment takes account of more parameters than the first embodiment. It is also immediately clear that second step 5 can then also take account of the balance amplitude in at least the 4 usual vertical test positions in order to poise the balance. Indeed, via gravity, the unbalance produces a torque which is added to the return torque of the balance spring and consequently produces an error of rate.

As explained above, since the last step 9 is intended to add material to the balance, the adjustment according to the invention only allows the moment of inertia I of the balance to be increased. It is clear, therefore, that the encased movement is preferably arranged to have a gain which will be corrected in the last step 9.

According to the second embodiment, the correction value corresponds to the asymmetrical distribution of at least one mass of material on the balance in order to alter the inertia of the balance and its centre of mass. It is clear that the correction value will be evenly distributed to poise the balance or to form an unbalance on the balance depending on the desired number of depositions. By way of non-limiting example, if the material is deposited on the balance rim, the correction value will be divided by the desired number of depositions. Next, a weighting operation is carried out according to the desired unbalance correction. It is clear thus that the balancing operation could consist of an asymmetrical deposition of material, i.e. a higher number of depositions in a specific sector of the balance and/or at least one deposition with a higher mass in a specific sector of the balance.

In whichever embodiment, method 1 ends with fourth step 9 intended to alter the balance inertia according to said correction value, by adding material to the balance.

This step 9 is preferably performed by material addition in a phase of jetting material onto the balance. This step 9 may be, for example, performed by fitting the movement into the case without the back cover or without the whole of the back cover.

This jetting phase can advantageously be performed by using an Optomec Aerosol Jet printer which makes possible very precise jetting with a very small volume of material. However, any other jetting or printing technology without using a mask is also possible. In a non-limiting manner, the material deposited on the balance can comprise an adhesive, a paint or a metal suspension.

Preferably, the material jetting phase is followed by a solidification phase of the jetted material. Depending on the material used, this second phase may consist in evaporating the solvent, thermo-hardening the material or cross-linking the material. Preferably according to the invention, a polymer is deposited on the balance during the first phase and then cross-linked during the second phase by means of ultraviolet radiation, which prevents, as far as possible, any contamination accidentally entering the movement.

Step 9 can be performed statically (immobile balance) or dynamically (movement in operation). In the latter case, as explained above, depending on the embodiment, second step 5 is important in order to determine the beat of the balance and, possibly, depending on the test positions, in order to synchronise the jetting of material to precisely deposit material on the balance.

Figure 2:
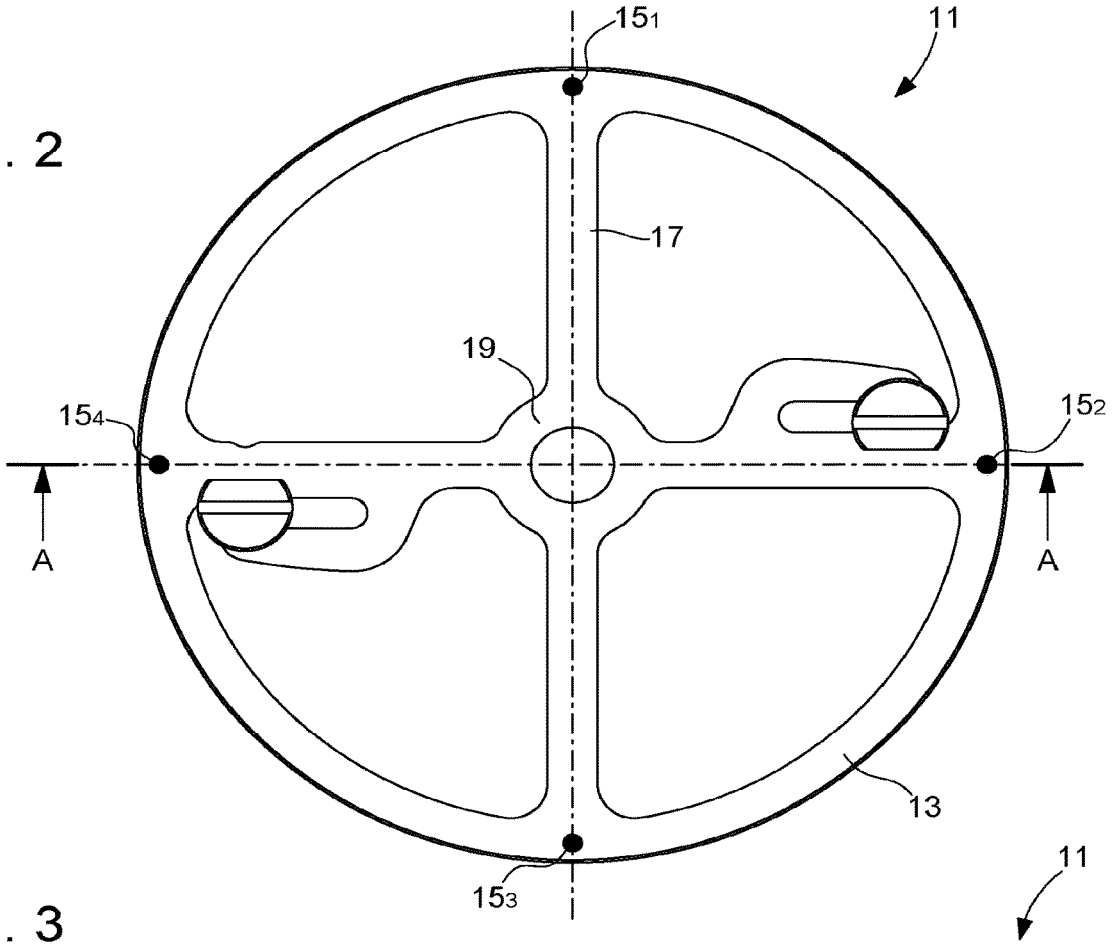
FIG. 2 is a top view of a balance after adjustment.
Figure 3:
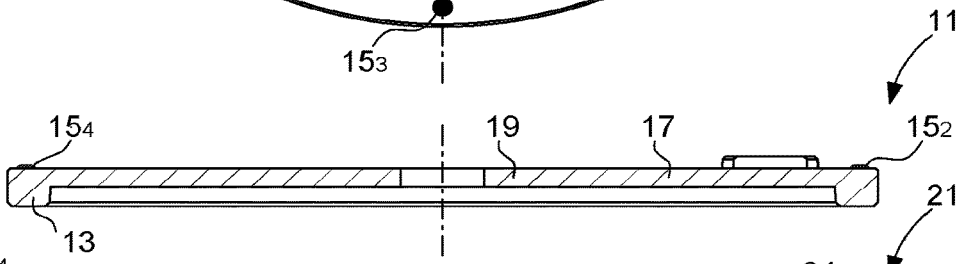
FIG. 3 is a view of FIG. 2 along cross-section A-A.

FIGS. 2 to 3 represent an example balance 11 modified after an adjustment according to method 1. As seen in the example of FIGS. 2 and 3, step 9 according to the first embodiment consisted in dividing the correction value into four identical masses of material $\mathbf{15}_1$, $\mathbf{15}_2$, $\mathbf{15}_3$, $\mathbf{15}_4$ arranged every 90° on rim 13 of balance 11 in order to finely adjust the timepiece.

Figure 4:
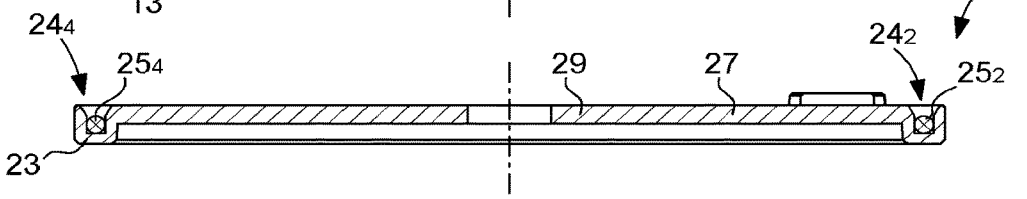
FIG. 4 is a sectional view of an alternative of FIG. 3.

According to an alternative intended to further limit contamination accidentally entering the movement, balance 21 could include recesses for receiving jetted material in step 9 and thereby prevent any splashing. As seen in the example of FIG. 4, step 9 consisted in dividing the correction value into at least two identical masses of material $\mathbf{25}_2$, $\mathbf{25}_4$ received in recesses $\mathbf{24}_2$, $\mathbf{24}_4$ of rim 23 of balance 21 in order to finely adjust the timepiece.

Of course, this invention is not limited to the illustrated example but is capable of various variants and modifications that will appear to those skilled in the art. In particular, if the encased movement includes an automatic winding mechanism, it could be tilted so that the oscillating mass does not conceal the balance.

Further, it also possible to envisage depositing material in places other than rim 13, 23, such as, for example, arms 17, 27 or hub 19, 29.

The invention claimed is:

1. A method for adjusting a rate of a timepiece comprising:

placing a movement including a balance/balance spring resonator inside a timepiece case without a back cover or without a whole of the back cover;

measuring a rate of the timepiece;

determining a correction value to be applied to a balance inertia to obtain a desired rate;

altering the balance inertia according to the correction value by adding material to the balance by fitting the movement into the case without the back cover or without the whole of the back cover.

2. A method according to claim 1, wherein the measuring a rate is performed with no contact with the balance/balance spring resonator.

3. A method according to claim 1, wherein the measuring a rate is performed optically or acoustically.

4. A method according to claim 1, wherein the correction value corresponds to a symmetrical arrangement of at least two masses of material on the balance to alter balance inertia without altering a center of mass of the balance.

5. A method according to claim 2, wherein the correction value corresponds to an asymmetrical arrangement of at least one mass of material on the balance to alter inertia of the balance and its center of mass.

6. A method according to claim 1, wherein the adding material is performed by a phase of jetting material onto the balance.

7. A method according to claim 1, wherein the material comprises an adhesive, a paint, or a metal suspension.

8. A method according to claim 1, wherein a material jetting is followed by a solidification of the jetted material.

* * * * *